US006988978B1

(12) United States Patent
Nault et al.

(10) Patent No.: US 6,988,978 B1
(45) Date of Patent: Jan. 24, 2006

(54) EXERCISE BAR CORD IMPINGEMENT ASSEMBLY

(76) Inventors: James Edward Nault, 2218 Luann La., Madison, WI (US) 53713; Robert Sylvester Hinds, 1803 Regent St., Madison, WI (US) 53705

( * ) Notice: Subject to any disclaimer, the term of this patent is extended or adjusted under 35 U.S.C. 154(b) by 215 days.

(21) Appl. No.: 10/406,423

(22) Filed: Apr. 2, 2003

Related U.S. Application Data

(63) Continuation-in-part of application No. 10/184,239, filed on Jun. 26, 2002.

(51) Int. Cl.
*A63B 21/00* (2006.01)

(52) U.S. Cl. ..... 482/126; 482/121; 482/907

(58) Field of Classification Search ..... 482/121–131, 482/907, 91

See application file for complete search history.

(56) References Cited

U.S. PATENT DOCUMENTS

| | | | | |
|---|---|---|---|---|
| 437,822 | A | 10/1890 | Reach | |
| 2,448,384 | A | 8/1948 | Meinzinger | |
| 3,117,781 | A | 1/1964 | Vargo | |
| 3,256,015 | A | 6/1966 | Perrin | |
| 3,355,171 | A | 11/1967 | Oesau | |
| 4,059,265 | A | 11/1977 | Wieder et al. | |
| 4,245,839 | A | 1/1981 | Trent | |
| 4,316,610 | A | 2/1982 | Hinds | |
| 4,328,964 | A | 5/1982 | Wells | |
| 4,779,867 | A * | 10/1988 | Hinds | 482/126 |
| 5,681,248 | A * | 10/1997 | Vani | 482/126 |
| 5,746,687 | A * | 5/1998 | Vial et al. | 482/126 |
| 5,911,535 | A * | 6/1999 | Gvoich | 482/124 |
| 6,398,698 | B1 | 6/2002 | Hinds | |
| 6,544,152 | B2 * | 4/2003 | Rosati | 482/126 |

* cited by examiner

*Primary Examiner*—Jerome W. Donnelly
(74) *Attorney, Agent, or Firm*—Loyd W. Bonneville

(57) ABSTRACT

An exercise bar cord impingement assembly permits exercise in two modes, defined in terms of how cord anchoring is arranged. There is a tunnel or, alternatively, a nest at each end of the bar where snug connection—a direct one—with a conventionally stoppered cord end is made. Handgrips may be employed with the assembly instead, in which case, each cord end is impinged not within the bar's body but within the grips—an indirect connection. A tunnel may have shared emplacement wells within it, preferably situated concentrically, one for the impinged cord, the other for an emplaced handgrip connection block. A handgrip's connecting block may be shaped in any of several ways for rotational positioning advantages. Cord emplacement slots are preferably present in both the bar and the block. In models having nests instead of tunnels, a cord emplacement channel is necessarily provided to get the impinged cord seated into place.

13 Claims, 12 Drawing Sheets

FIG 6
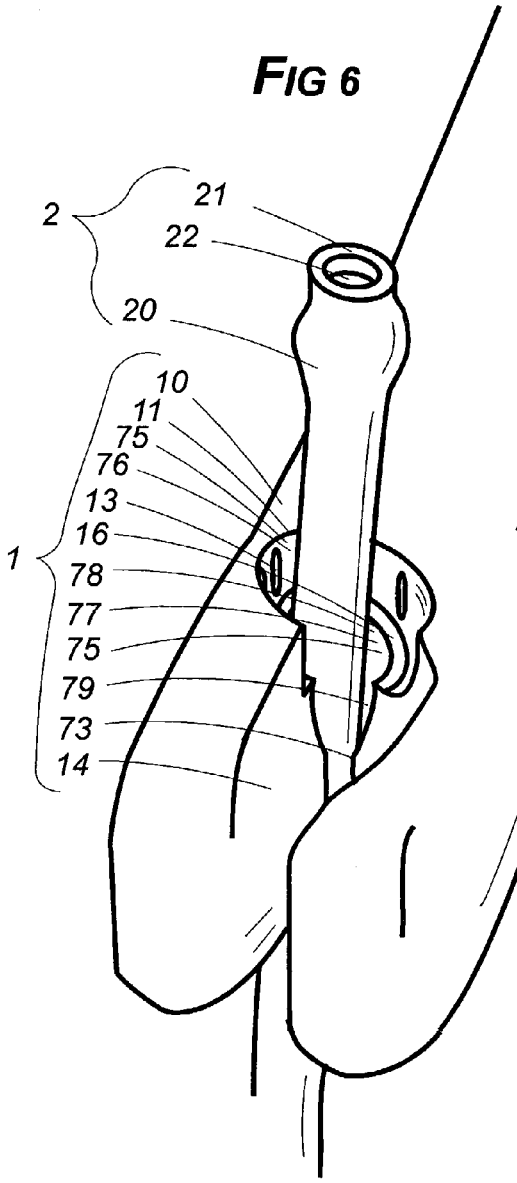
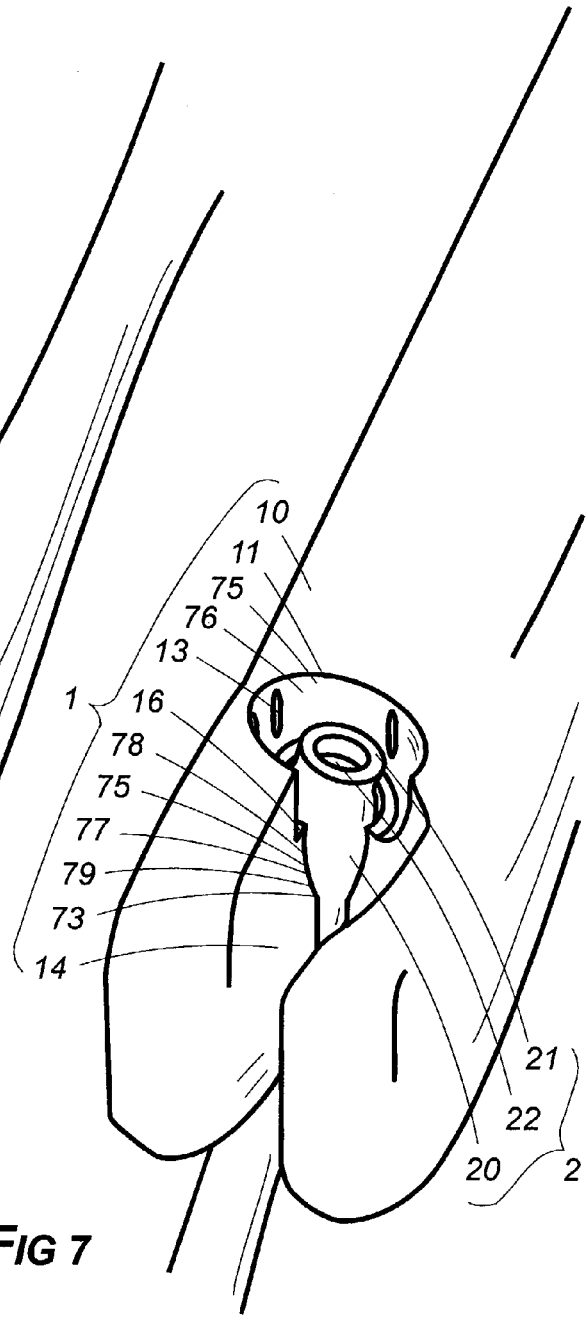
FIG 7

FIG 14
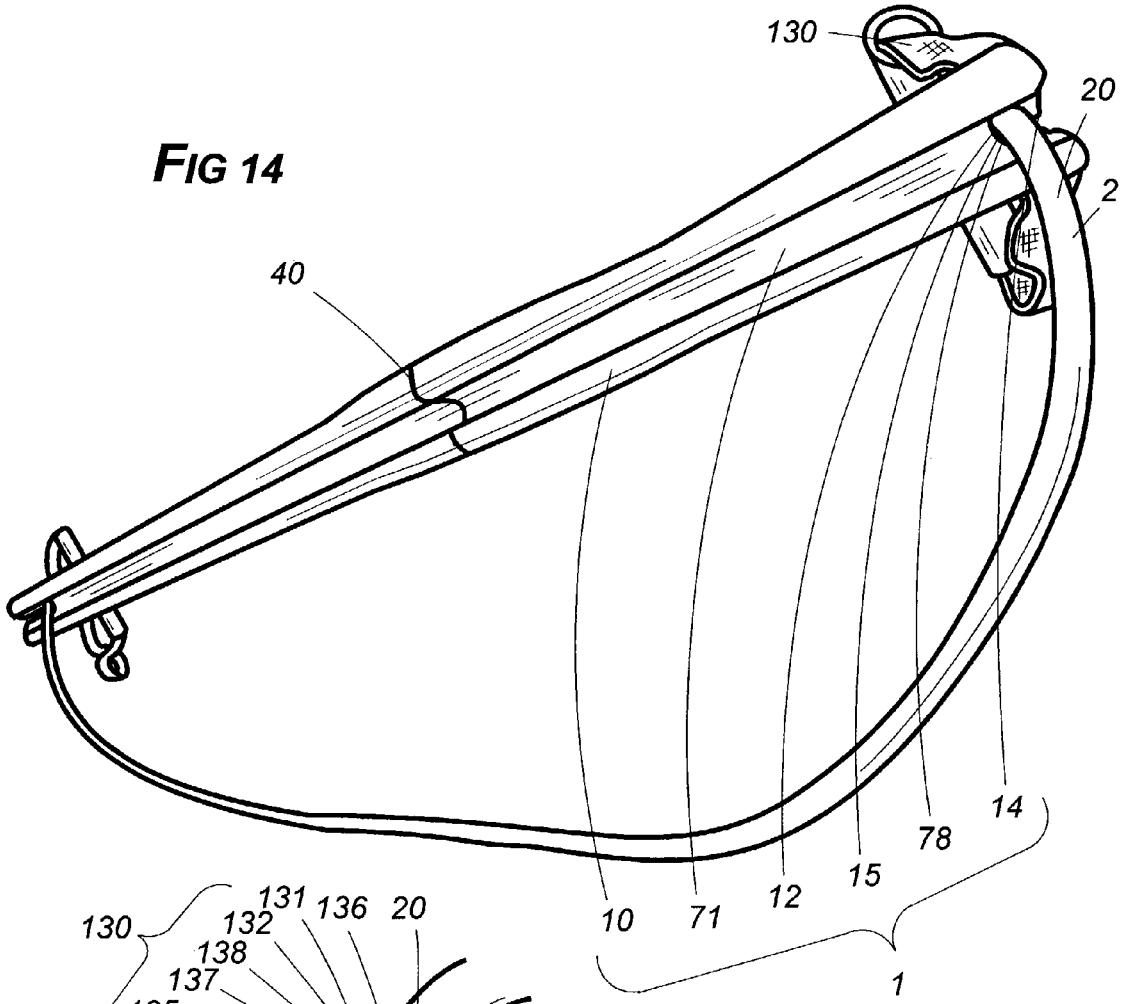
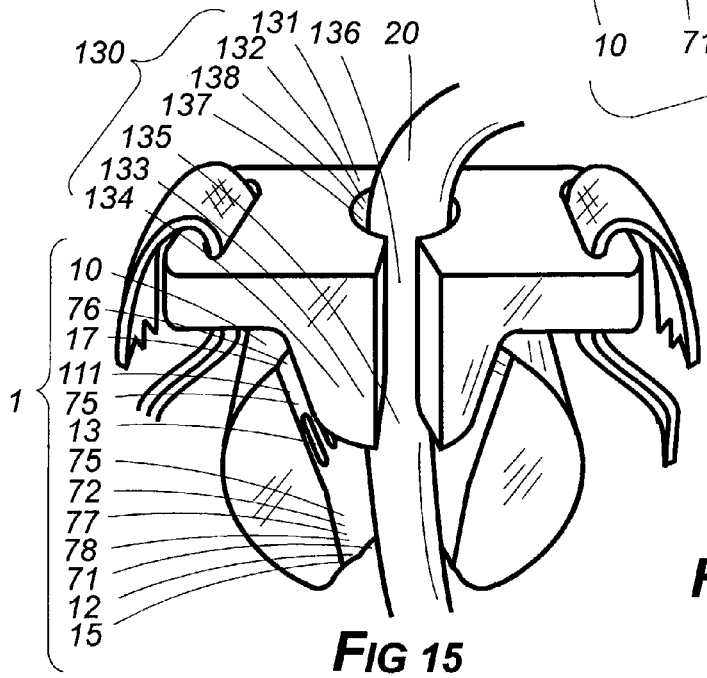
FIG 15
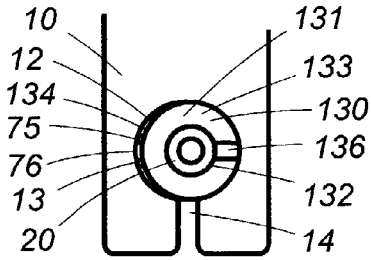
FIG 16

FIG 20
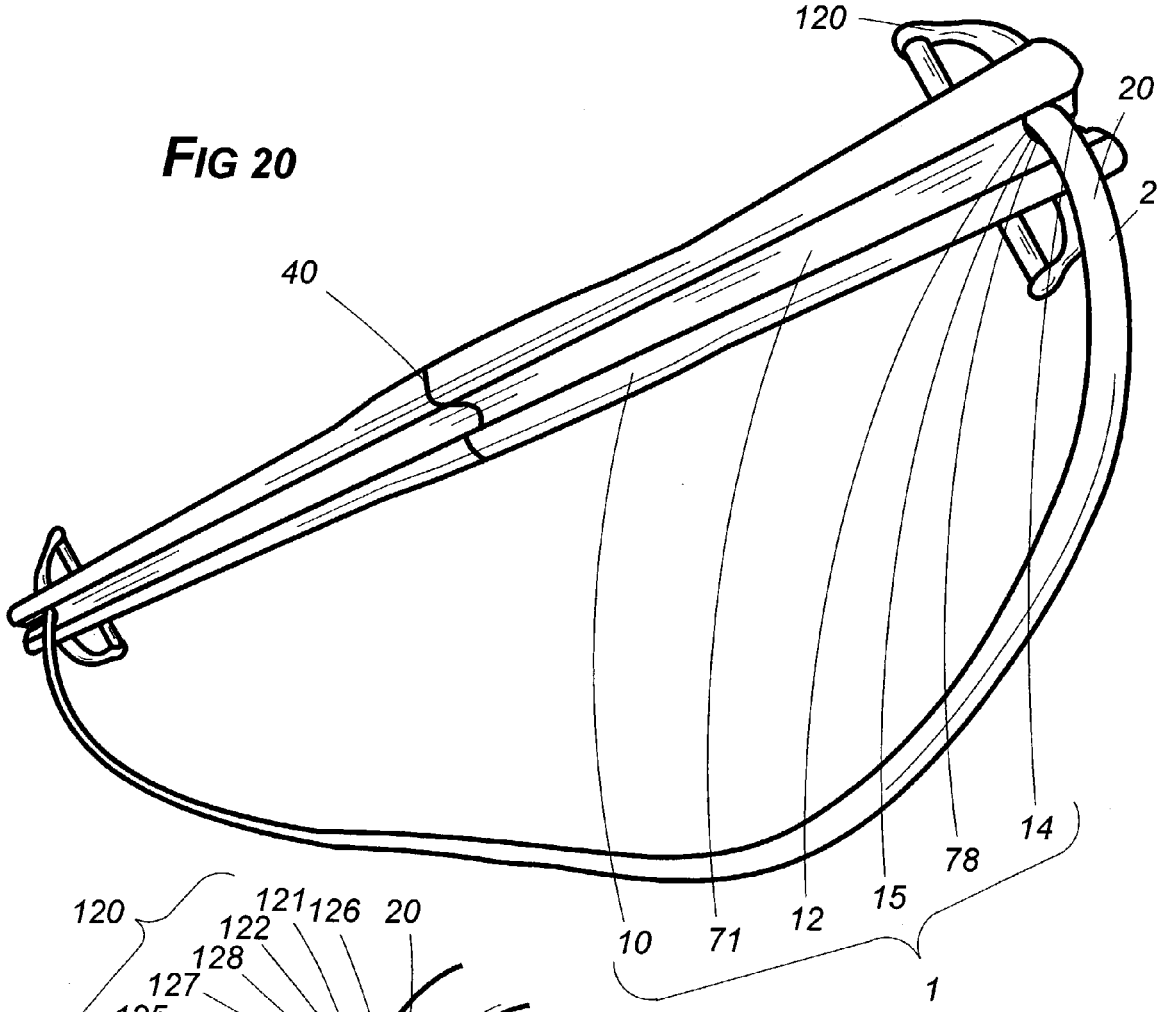
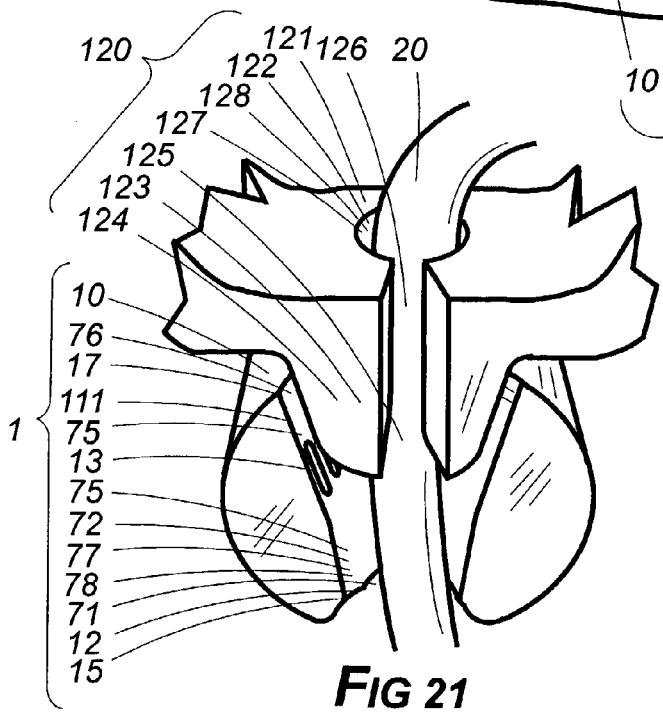
FIG 21
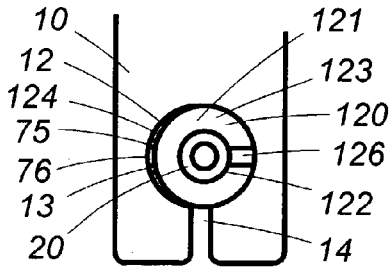
FIG 22

EXERCISE BAR CORD IMPINGEMENT ASSEMBLY

This instrument, filed under 37 CFR 1.53(b) and 1.78, invoking the provisions of 35 U.S.C. 120, is a Continuation-in-Part of presently copending application Ser. No. 10/184,239 entitled "Exercise Bar and Cord Assembly", filed Jun. 26, 2002.

BACKGROUND OF THE INVENTION

1. Field of the Invention

Exercise equipment

2. Description of the Prior Art

Occasionally a descriptive term in this application may be shortened so as to recite only a part rather than the entirety thereof as a matter of convenience and to avoid needless redundancy. In instances in which that is done, applicant intends that the same meaning be afforded each manner of expression. Thus, the term exercise bar's block impingement nodes (13) might be used in one instance but in another, if meaning is otherwise clear from context, expression might be shortened to impingement nodes (13) or merely nodes (13). Any of those forms is intended to convey the same meaning.

The term attach or fasten or any of their forms when so used means that the juncture is of a more or less permanent nature, such as might be accomplished by bolts, welds or adhesives. Thus, it is state herein that the connection of the cord enwrapment pegs to the end of a prior art exercise bar (100) is one of attachment, for which purpose molded one-piece construction is typically employed. A connection in which one object is easily removed from another is described by the word emplace, as where it is stated herein that in preparation for the assembly's use, a handgrip's cord connecting block (121, 131) is emplaced within one of the bar body's second openings (17). A connection in which two objects, though not attached, could be separated only with at least some degree of difficulty is referred to herein as one of rigid emplacement. The connection between the impingement plug (22) within an end of an elastic hollow exercise cord (20) into which it (22) is fully inserted is stated herein to be such a connection. Because the firm retention of a stoppered (22) exercise cord end (21) at an impingement site (78, 128, 138), ante, does not quite rise to the level of rigid emplacement, the term impingement is instead used to describe that union. Employment merely of the words connector join or forms derived from their roots is intended to include the meaning of any of those terms in a more general way.

The word comprise may be construed in any one of three ways herein. A term used to describe a given object is said to comprise it, thereby characterizing it with what could be considered two-way equivalency in meaning for the term. Thus, it is stated that FIGS. 9 and 10 comprise cross-sectional views of certain portions of the invention, meaning that those two drawings actually are those views. The term comprise may also be characterized by what might be considered one-way equivalency, as when it is stated herein that the stoppered (22) exercise cord end (21) comprises the impingement means employed to connect the cord (20) to the bar's body (10), meaning that in the given instance, that object is itself the type of impingement employed. This use of the word has a generic sense to it. That is, the stoppered (22) cord end (21) will always—at least potentially—be an impingement means (200) but means of impingement (200) may be the stoppered (22) cord end (21) in one case but something else such as a knot in another. However, the word comprise may also be used to describe a feature which is part of the structure or composition of a given object. Thus, a bar separation assembly (4) is stated to preferably comprise, among other things, a button opening (43) as a component thereof. The meaning in the respective cases is clear from context, however. Accordingly, modifying words to clarify which of the three uses is the intended one seem unnecessary.

Terms relating to physical orientation such as top or bottom, upper or lower, refer to the positioning of the assembly in the manner it would be observed during a commonly practiced mode of operation. This convention has been adopted as a matter of convenience in discussing orientation and as shown in the drawings. Thus, the cord stretching recess (71), when present, is described as being disposed longitudinally along the underside of the bar's elongated body (10); that it is a common practice when using an exercise bar assembly to anchor the elastic cord (20) beneath the standing operator's feet and then pull upwards upon the rod—or elongated body (10); and that in second mode operation, the bar (100) may be raised above his or her head. The use of the terms in this manner must, of course, be interpreted so as to be equally understood regardless of what attitude the assembly is positioned—such as, for example, when it is inverted in switching from one mode of operation to another. In such instances, it is appropriate to specifically qualify what is meant by such recitations as on top of or beneath.

The word longitudinal and derivations thereof refer merely to the longest dimension of a given object, provided it has one. Thus, it is stated herein that the cord stretching recess (71) along the elongated body's (10) underside is longitudinal in disposition. This merely means that the recess (71) is oriented along the length of the rod's elongation (10).

The term reeve, or any of various forms thereof, is occasionally employed herein. It is stated, for example, in an embodiment in which no cord emplacement slot (14) is present, that a non-stoppered elastic cord end (21) must be extended through the bar body's tunnel (12) by enreevement. This merely means that it (21) is inserted through, strung or threaded in the familiar manner.

In some cases, the same word expressed as a noun is also used for a verb. Thus, it is stated, for example, that the handgrip's connection block (121, 131) comprises the tunnel (12) referred to just ante, which is the conduit through which the cord (20) passes. Yet, it might have been just as properly stated that the cord (20) tunnels through the block (121, 131). The propriety of this divergent use of the term is established by the dictionary. Occasionally, however, certain words may be coined herein to simplify discussion by interchanging noun, verb or adjective or by modifying certain words. For example, co-engagement is a term occasionally applied to describe the relationship of objects brought into conjunction with one another in a particular way by some mutual interrelationship.

Because in this presentation most, if not all, of the principles involving combination with a solid handgrip (120) apply equally to a strapped one (130), to avoid prolixity of expression, the two (120, 130) and sub-elements thereof (120, 130) have been expressed in conjunction with one another—for example, (121, 131)—for a compound reference to what would otherwise be referenced as the solid handgrip's connection block (121) and the strapped handgrip's connection block (131).

The lifting of the body of a rod or bar (100) of an exercise bar assembly of one sort or another against the resistance of a stretchable exercise cord (20) has become an increasingly popular form of exercise. It has been with us for some time and, in general, any improvements upon it tend to express subtleties which, at least at first glance, appear to be only incidental.

Two general prior art arrangements suggest themselves in this connection. In a first mode, the ends of the stretchable cord (20) are anchored in some manner and a mid-portion thereof (20) is run through or suitably seated upon the body of the bar (100) which may then be tugged in a beneficial manner. The cord ends (21) may terminate at any improvised connection system—for example, either a strap impinged in the crack of a door or in any one of several securing mechanisms present on a wall mounted exercise combination or with the operator's feet emplaced within [solid] handgrips (120, 130) at the cord ends (21). The exercise is conducted by stretching the cord's (20) mid-portion upwards by appropriate use of the bar (100). In a second mode, it is the mid-portion of the cord (20) which is anchored in some manner, the ends thereof (20) being securely connected to the exercise bar's body (100). The mid-portion may be secured at a door or wall by any of several means imaginable or may, in a manner somewhat similar to that considered for the first mode, supra, be self-anchored such as by standing upon it. In either modality, it is quite common for the operator to grasp the opposing ends of the bar's body (100) and raise it (100), stretching the cord (20) to a point far above his or her head. Either way, the combination becomes a convenient portable substitute for cumbersome weight lifting apparatus.

One line of development involved enwrapping a portion of the elastic cord (20) around the ends of the exercise bar (100) in order to effectually shorten the cord's (20) length and increase its (20) resistance. The technique could be employed in either of the two modes of exercise operation. If the cord's (20) mid-portion, for example, were disposed along or within the elongation or body of the bar (100), opposing portions thereof (20) would have been enwrapped or twisted about the bar body's (100) ends. It was not uncommon to attach cord enwrapment pegs to the body (100).

The undertaking of the wrapping convenience to effectually shorten cord (20) length came only at a cost, however. As the cord (20) bunched up at the bar (100) ends, torque built up—a twisting phenomenon the operator had to work against. That unwanted force tended to diminish the ordinarily sought-after benefits from operation of an elastically anchored lifting bar body (100) in either mode of exercise. Moreover, it was observed that a solid handgrip (120), by reason of the obstruction presented to it (120) by such pegs, cannot be arbitrarily rotated once the connection block (121) had been emplaced and fitted into the end of the bar's body (100). Other than that shown, the only position it (120) could occupy without interference with any present is 180 degrees away. In that respect, therefore, the inclusion of integrally disposed cord (20) enwrapment pegs upon the body (100) might well have been and perhaps still remains to be considered an impediment rather than a beneficial feature.

Prior art handgrips, either of the solid variety (120) or the strapped (130), are addressed herein, nonetheless, as feasible combining members. As widely recognized in the art, a stoppered (22) elastic cord end (21) was connected by means of impingement (200) to a solid handgrip's connection block (121) at a cord impingement site (128) within a cord tunnel (122). It is the base or stem of the solid handgrip (120) which comprises its connection block (121). The strapped handgrip's connection block (131) is the subject of other patents and essentially amounts to a solid site of conjunction for the exercise cord (20) and the straps of the handgrip (130). The tunnel (122) comprised a first opening (125) of size accommodating the disposition of a stretchable exercise cord (20) therethrough and an oppositely disposed second opening (127). It was the connection block's neck (123) which became emplaced within the exercise bar's body (100).

As now recognized, impinged cord connection (200) has more recently been extended to the strapped handgrip (130) at a cord impingement site (138) within its own tunnel (132). Consistently, it is the neck (133) of a strapped handgrip connection block (131) which has become emplaced within the body of the bar (100) at the tunnel's second opening (137) and it is a first opening (135) which has come to accommodate the disposition of the stretchable cord (20). And in very recent art, the cord (20) has been brought into impingement position through a cord emplacement slot (126, 136, respectively) disposed in the connection block (121, 131) of either handgrip (120, 130). In short, the cord (20)-to-bar (100) impingement concepts associated with the solid handgrip (120) may now be considered to have become translated over to the strapped one (130).

As an incidental matter, the configuration of the solid handgrip (120) facilitates its (120) removal in that the bifurcations inherent in its (120) structure are situated such that one's fingers may be slipped conveniently underneath to pull it (120) out.

In U.S. Pat. No. 437,822 issued to Reach, a tug-of-war belt was provided which, despite the absence of any bar (100) and elasticity in the intermediate cord, could be considered to have encompassed in a very general way the concept of the first mode mentioned supra, the mid-portion of the rope partially encircling the operator's waist. Ultimately, of course, systems such as that shown in U.S. Pat. No. 4,245,839 issued to Trent emerged again de hors the bar (100) but, rather, employing a tugging belt with the cord ends (21) terminating in door crack impingement. Earlier, a cord (20) mid-portion impingement mechanism had been cleverly developed in U.S. Pat. No. 2,448,384 issued to Meinzinger which temptingly suggested that a portion of the cord (20) might be secured by operable spring loaded impingement. An exercise bar (100) of sorts did appear, however, in U.S. Pat. No. 4,328,964 issued to Walls, although it was not contemplated therein that the elastic cord's (20) mid-portion actually be directly stretched by the operator—but rather, an unanchored end thereof (20) in tennis racket swinging fashion. Then U.S. Pat. No. 4,195,835 issued to Hinds, et al and U.S. Pat. No. 4,316,610 issued to Hinds, in somewhat cumulative perspective, provided an exercise bar (100) featuring the cord (20) enwrapment means addressed supra. The latter of those patents also provided a useful bar body (100) separation exercise combination comprising snap-fit means of connection (400) to interconnect opposing sections of the body (100) as well as other features which should be included among the components of any exercise bar assembly. In all of this line of patents, anchoring was accomplished upon a cord end (21) at a point remote from the focal point of lifting activity, evincing to a lesser or greater degree the first mentioned mode of operation.

A suggestion along the line of the second mode of operation, that involving mid-portion anchoring of the cord (20), was provided in U.S. Pat. No. 3,355,171 issued to Oesau, although that prior art assembly incorporated separate chains in lieu of a continuous elastic cord (20) and its particular application involved running them to an anchoring rod the operator stood upon. U.S. Pat. No. 3,117,781 issued to Vargo featured an exercise bar body (100) designed for use a little more in the manner considered here, in which the mid-portion of the cord (20) was anchored into a platform the operator stood upon. In U.S. Pat. No. 3,256,015 issued to Perrin, the cord ends (21) were fastened by interweaving them through holes drilled in the body or bar (100) ends so that the operator could exercise by standing upon the cord's (20) mid-portion. U.S. Pat. No. 3,256,015 issued to Wieder, et al featured a hollow body for the bar (100) with which connection was accomplished by running the cord ends (21) longitudinally in opposition through tunnels within. Again, the operator stood upon the cord's (20) mid-portion during exercise.

Finally, U.S. Pat. No. 4,779,867 issued to Hinds featured an exercise bar body (100) which could be anchored for whichever mode of exercise was engaged in—the anchoring being provided for either at the ends of the cord (20) or at its (20) mid-portion. That assembly of prior art was also presented to suggest two-piece configuration for the body of the bar (100), although specific details supporting snap-fit or other means of interconnection previously witnessed in Hinds U.S. Pat. No. 4,316,610, supra, were now wanting. Admirably, the bar's body (100) also included a cord stretching recess (71) along its (100) length in which a hollow cord's (20) mid-portion would have been securely seated for first mode operation. At the body's (100) ends, that combination also comprised cord (20) enwrapment pegs then thought beneficial for second mode operation.

That last exercise combination fairly well captured the features desired for versatility of use. However, for employment in the second of the two modes of exercise considered, troublesome shortcomings remained concerning the actual anchoring of the cord ends (21) upon the bar's body (100). Connection was accomplished by allowing the base of a pair of handgrips (120) to be emplaced within sockets shaped to snugly accommodate them (120) in the body (100) ends. That, however, resulted in a rather bulky arrangement and the handgrip (120) rotational difficulties presented by cord (20) enwrapment pegs discussed supra had to be reckoned with. It is likely an operator, other things being equal, would opt to employ the combination only in first mode operation rather than encounter those difficulties.

The Hinds provision for handgrip (120) connection to engage in the second mode of exercise, supra, may properly be considered to have been the harbinger of possibilities yet to come. For example, the specially formed strapped handgrip tunneled block (131) alluded to, supra, has been a more recent significant innovation adaptable to emplacement in that exercise bar (100). Unfortunately, however, as with the solid handgrip (120), that device can be oriented in but one direction upon emplacement. While a novel exercise bar (100) might just as well continue to incorporate those already existing connection features, it would be highly useful to have with us a handgrip connection block (121, 131) for a connector which is not limited in orientation but which could be emplaced in any radial position within a bar (100) end socket.

At first, exercise cords (20) were often merely knotted at the cord's end (21) for reliable connection to a solid or strapped handgrip's connection block (121, 131, respectively), the knot's bulk preventing the end (21) from slipping out of the opening therein (121, 131) it (20) had been reeved through. Since then, the embedding of an impingement plug (22) within the end (21) of a hollow exercise cord (20% a stoppered (22) cord (20), as it were—has come to comprise the most popular means of impingement (200). The firm connection which was provided between the knotted or plugged (22) cord end (21) and a handgrip connection block (121, 131) or any other suitable connection site is referred to herein as means of impingement (200). The tunnel (132, 232) through which the cord (20) is passed within a handgrip connection block (121, 130) has generally been shaped to permit the wider stoppered (22) portion of the cord (20) to lodge within it (132, 232), becoming impinged in place by a firm tug upon the cord (20). The closer the match, the snugger the fit and better the impingement. The locus of connection within a solid handgrip's connection block (121) is designated a solid handgrip's cord impingement site (128), that within a strapped handgrip's connection block (131), a strapped handgrip's cord impingement site (138). The tunnel (122, 132) has sometimes been conically configured, although slight concavity of curvature tending to mate to a portion of the stoppered (22) cord (20) has generally been preferred.

One might well ask, where second mode exercise is conducted, why the ends of the more recent prior art exercise bar's body (100) might not themselves have a been modified to serve as connectors for a hollow cord (20) combination at least in this exercise modality. Is it not thus true for such a connection that the hollow stretchable cord (20) with a plug-like impinger (22) stuffed within its end (21) would be stretched to make it (20) slip through the narrow slot in the body of the bar (100) end in the same manner it was done at prior art to connect the base or block (121) of a solid handgrip (120) to it (100). Would not interchangeability of one hollow cord (20) for another (20) of different stretchable resistance be facilitated?

Lest one be further tempted to ask whether a handgrip (120) should have been so employed at all, one should recognize that it is not uncommon for an exercising operator manipulating either a solid or a strapped handgrip assembly (120, 130) to whimsically shift his or her efforts to the lifting and tugging benefits of an exercise bar combination. It would be convenient to simply connect the handgrip (120, 130) to the elongated body of an exercise bar (100) without dismantling it (120, 130).

It is, of course, appropriate to recognize the new developments in cord (20) impingement within handgrips (120) which have occurred. These obviate the interchanging of cords (20) merely to work with a longer or shorter one (20). It may not be feasible to work with an impinger (200) either kept separately from the combination—in which case it (200) would be vulnerable to misplacement or loss—or installed on the body of a retrofitted exercise bar (100), an alteration which would likely prove unattractive and cumbersome.

It could be inconvenient for an operator shifting from exercises with a handgrip assembly (120, 130) to those with an exercise bar combination to readjust the cord (20) length for the latter endeavor. A readily available supply of longer and shorter exercise cords (20) with stoppered (22) ends (21) would make it convenient to merely change to one of them (20).

While there are good reasons, then, to provide for exercise cord (20) interchangeability and connection without benefit of handgrips (120, 130) at all, there remain other important ones, nevertheless, to retain the handgrip (120, 130) connecting capability as well.

Merely switching an exercise cord (20) stoppered (22) at each end (21) with one (20) connected to a solid or strapped handgrip (120, 130, respectively) do not quite fulfill the objectives of convenient alternative usage, however, because the configurations of the handgrips' emplacement structures (121, 131) differ considerably from—in particular, are larger than—that of a cord end (21) bearing an impinging plug (22). Mere substitution of the latter (21, 22) for the former (121, 131) would result in an unwanted very loose fit, possibly even allowing the stoppered cord (20, 22) to slip out of place altogether during use. But a novel structural modification could provide the accommodation of both (21, 22 and 121, 131).

What is needed is an exercise combination in which the familiar prior art exercise bar (100) is modified so that one might conveniently interchange one arrangement for another. It would be advantageous to bring a stretchable exercise cord (20) into use in an exercise bar (100) combination otherwise dedicated only to that with a solid handgrip (120). It would also be advantageous to bring a strapped handgrip (130) into use in that combination. The strapped handgrip connection block (131) is, for all practical purposes, identical with the base or connecting block (121) of the solid handgrip (120). It should be possible to somehow change the body of the bar (100), for example, so that one might switch from independent handgrip (120, 130) and exercise cord (20) use to combined bar body (100) and cord (20) use; from one cord (20) connected to the body (100) to another (20); from combination of bar body (100) and cord (20) to that of body (100) and solid handgrip (120); from combination of bar body (100) and solid handgrip (120) to that of body (100) and strapped handgrip (130); from combination of bar body (100) and either handgrip (120, 130) to independent cord (20) and handgrip (120, 130) use; and so on.

To a given extent, the more recent assemblies provided in prior art favorably address some of the needs and objectives pursued in this realm of exercise. As we have seen, however, there are those which still remain to be met.

SUMMARY OF THE INVENTION

In its most important aspect, the invention is an assembly permitting expedient connection of an exercise cord assembly (2) to an exercise bar assembly (1) without the incorporation of handgrip connection blocks (121, 131), although provision is still made to retain handgrips (120, 130) for optional use. The exercise bar's elongated body (10) is adapted to accommodate within it (10) the lodging of the impinged (22) end (21) of a stretchable exercise cord (20) by carving within it (10) either a tunnel (12) or an underlying cord impingement nest (18). The nest (18), having only one opening (19), may be thought of as the lower half or so of a tunnel (12), which has two of them (15, 17). The cord's (20) entrance point into a nest (18) is, therefore, said to comprise merely a nest opening (19); that for a tunnel (12), a first opening (15) thereof (12). Whether tunnel (12) or nest (18), the cord's (20) entrance opening (15, 19, respectively) must be large enough to encompass its (20) diameter but too small to allow its stoppered (22) end (21) to pull trough.

The tunnel (12) may comprise within it (12) shared cavity emplacement wells (75), usually two, concentrically disposed (72) one (72) atop the other (72). The uppermost is designated a handgrip block emplacement well (76), the lower, a cord impingement well (77). This arrangement allows its contents—connection block (121, 131) or impinged (22) cord end (21)—to be more snugly fitted and is preferably characterized by a constriction about mid-way along the tunnel's (12) descent. In some models, a block retaining ledge (16) is disposed there, providing a seating place for the handgrip's connection block (121, 131). In some, to provide a more secure connection, impingement nodes (13) are formed along the walls of the block emplacement well (76) and the connection block's neck (123, 133) configured with an impingement sector (124, 134).

Because it has become almost asinine to undertake the many-year-old practice of repeatedly reeving a cord (20) through a small opening and then either knotting it (20) or inserting an impingement plug (22) into its end (21), special attention has been paid to getting the impinged (22) cord end (21) into place. The handgrip connection bar's (121, 131) slotted pathway (126, 136, respectively), more recently provided by applicant in a previous patent, is carried over herein so that a portion of the cord's (20) mid-length may be either stretched and slid along through an emplacement slot (14) in the bar's body (10) leading to a tunnel (12) or manipulated into a cord emplacement channel (11) leading to an impingement nest (18), depending upon which (12 or 18) is present.

The handgrip connection block's neck (123, 133% the portion of the handgrip (120, 130) which is emplaced within the tunnel's second opening (17)—may take any one of several conceivable forms in cross-section. Rotational positioning of the connection blocks (121, 131)—say, to dispose a handgrip emplacement slot (126, 136) and the body's emplacement slot (14) or channel (11) in deliberate misalignment—is made feasible by configuring the block's necks (123, 133) with axial symmetry. Obstructions otherwise encountered during rotational positioning upon a prior art exercise bar (100), such as the older-fashioned enwrapment pegs, are eliminated by streamlining the bar body (10) to confer upon it (10) what is designated herein to be continuously contoured projection.

Although a snap-fit bar separation assembly (400) is not unknown to the art as a portability feature, the preferred model herein (4) includes a grasshopper spring (42) and release button (41) version.

While the exercise assembly which is the subject hereof features a patentable combination of members, most of which are familiar to us, they might perhaps equally well be billed as improvements to the prior art model (100). So presented, the number of improvements would be at least two because of the exercise bar's specially shaped emplacement wells (75) and the snap-fit mechanism (400) of the bar's separation assembly (4) featured herein.

BRIEF DESCRIPTION OF THE DRAWINGS

Solid lines in the drawings represent the invention. Dashed lines represent either non-inventive material, that not incorporated into an inventive combination hereof and which may be the subject of another invention, or that which although so incorporated, lies beyond the focus of attention.

Figure 1:
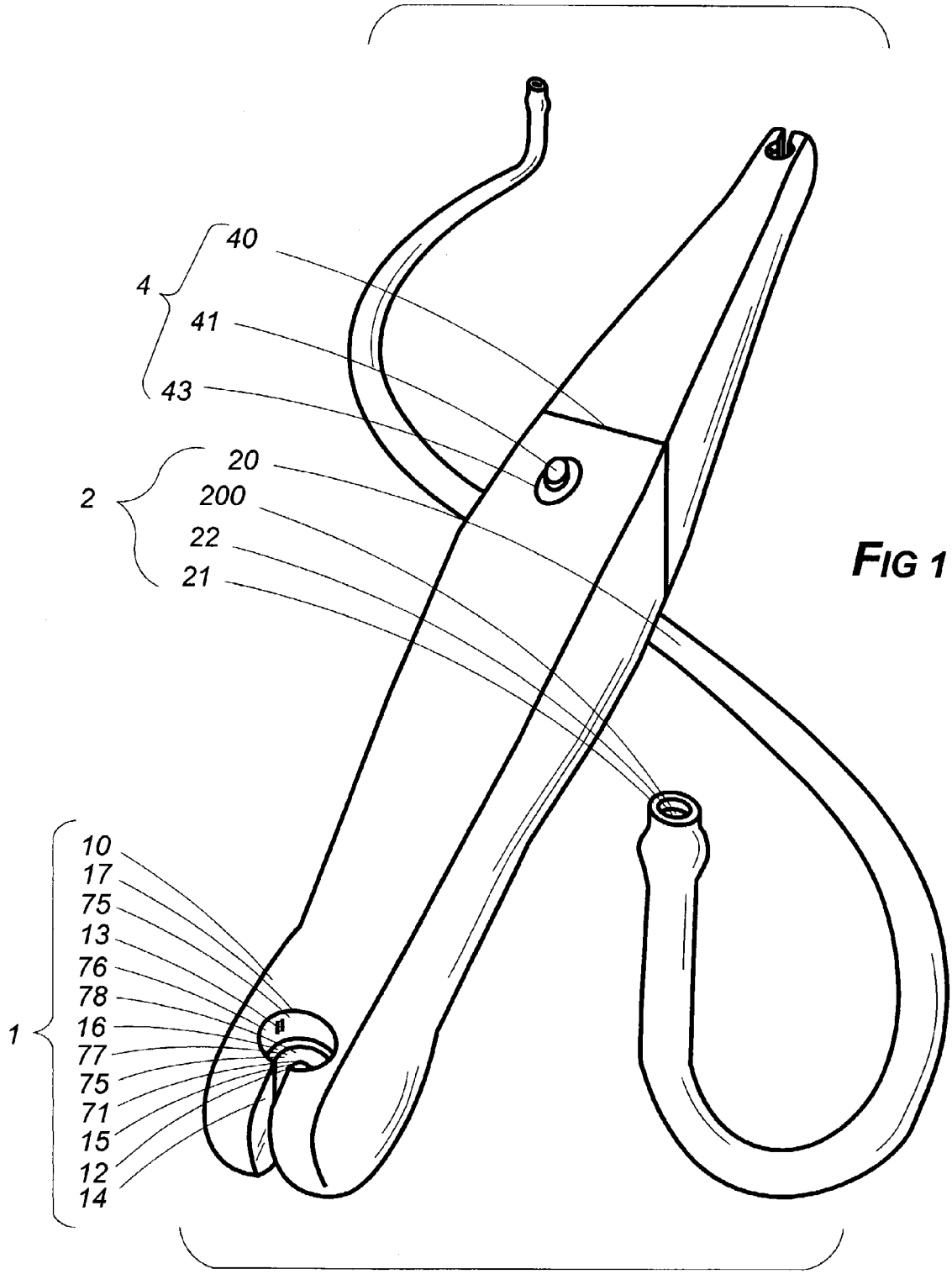
FIG. 1 represents an embodiment of the assembly in which the exercise bar's elongated body (10) is configured with tunnels (12) within which the ends (21) of a hollow stretchable exercise cord (20) with impingement plugs (22) inserted into them (21) are secured. The body (10) features a bar separation assembly (4) at its mid-portion.
Figure 2:
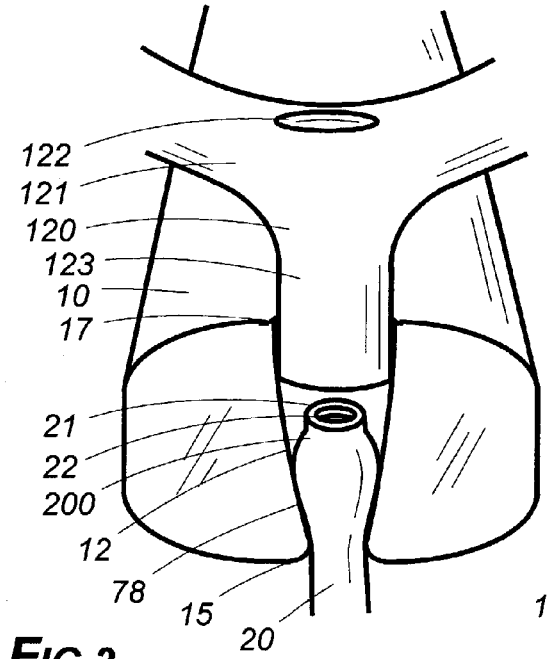
FIG. 2 is a perspective cut-away depiction in cord (20)-to-bar body (10) connection accomplished within a simple tunnel (12) comprising neither shared cavity emplacement wells (75) nor a block retaining ledge (16) as part of structure. The tunnel's (12) arcuate wall alone accommodates both an impinged cord (22) and the connection block (121) of a handgrip—a solid stirrup-like one (120) in this case, although that (131) of a strapped handgrip (130) would do just as well, ante. The connection block (121), which would ordinarily be employed only if the cord (20) were connected to it (121) instead of to the exercise bar's body (10), is included in the drawing only to emphasize the point.
Figure 3:
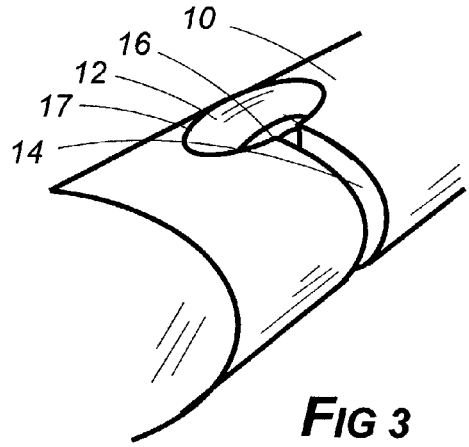
FIG. 3 illustrates a cord emplacement slot (14) disposed along the sides of the body (10) and indicating an approach to cord (20) impingement other than from the body's (10) end.
Figure 4:
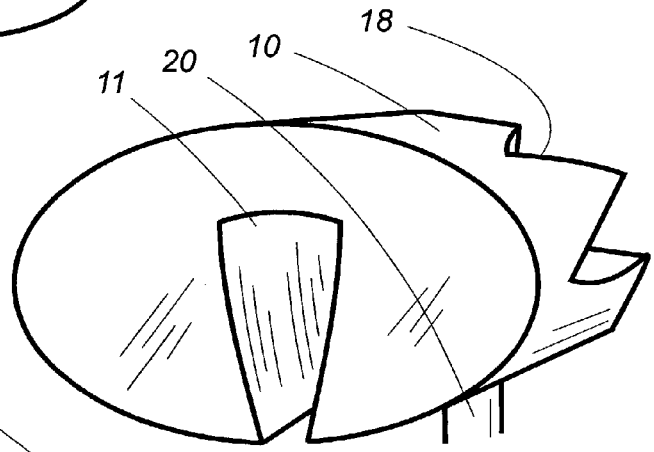
FIGS. 4 and 5 address the underlying cord impingement nest (18). The former of the drawings shows the connected cord (20) in place within the body (10) as well as the entrance to the cord emplacement channel (11). The latter of the drawings, depicting a cut-away view—permits an observation of the impinged cord end (21, 22) within the body (10).
Figure 5:
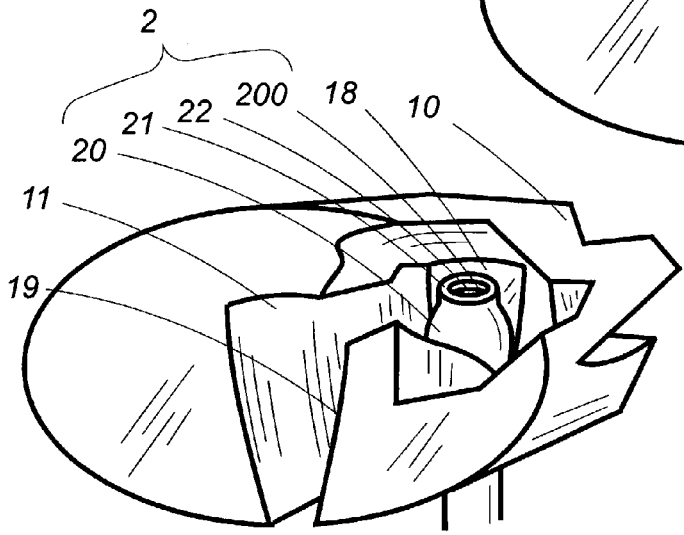

In the cut-away illustrations of FIGS. 6 and 7, the tunnels (12) comprise shared cavity emplacement wells (75). Both the handgrip block emplacement well (76) and, beneath it (76), the cord impingement well (77) are shown, the latter (77) comprising configuration mated to an exercise cord's stoppered end (21, 22) to assure secure co-engagement. The first drawing shows the impinged cord (22) poised for withdrawal into the tunnel (12) for secure connection. The second one shows it (22) actually pulled down into place.

Figure 8:
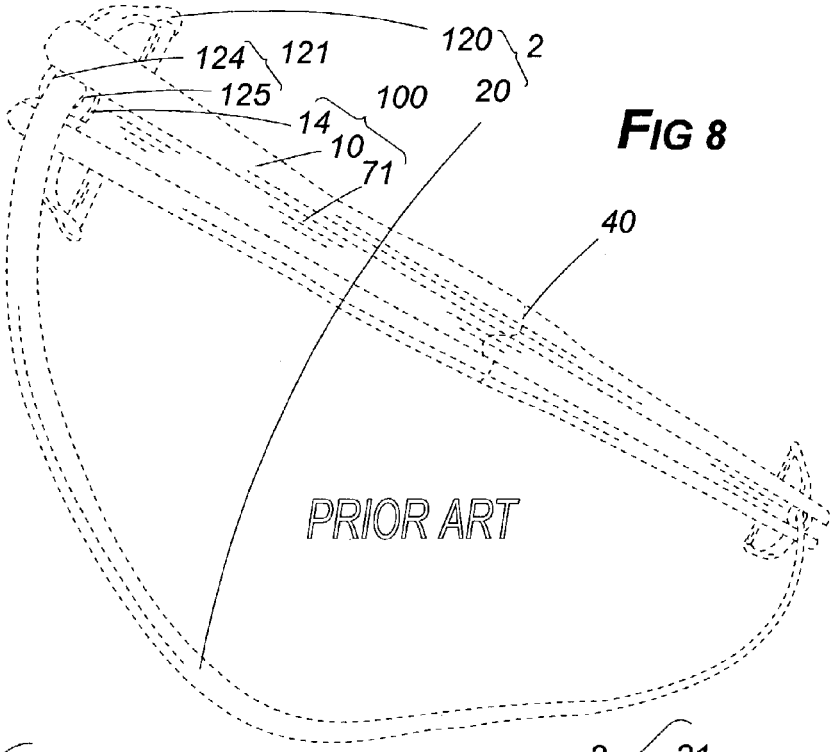

FIG. 8 depicts in perspective an assembly in which the bases or cord connection blocks (121) of a pair of solid handgrips (120) are emplaced in a prior art exercise bar (100) in which shared cavity wells (75) and certain features which are the subject hereof are absent. In this view, the entire length of the cord stretching recess (71) which made first mode exercise feasible, supra, is shown. Also open to view here are parts of the connection blocks (121) sticking through the bar's body (10), disclosing a structure different from that of FIGS. 14 and 20, ante.

Figure 9:
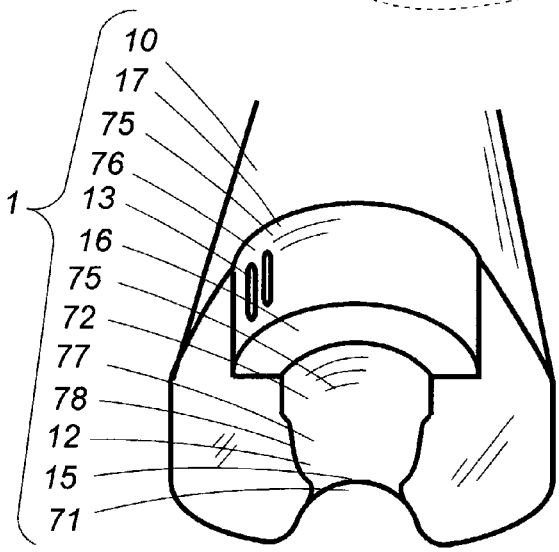
Figure 10:
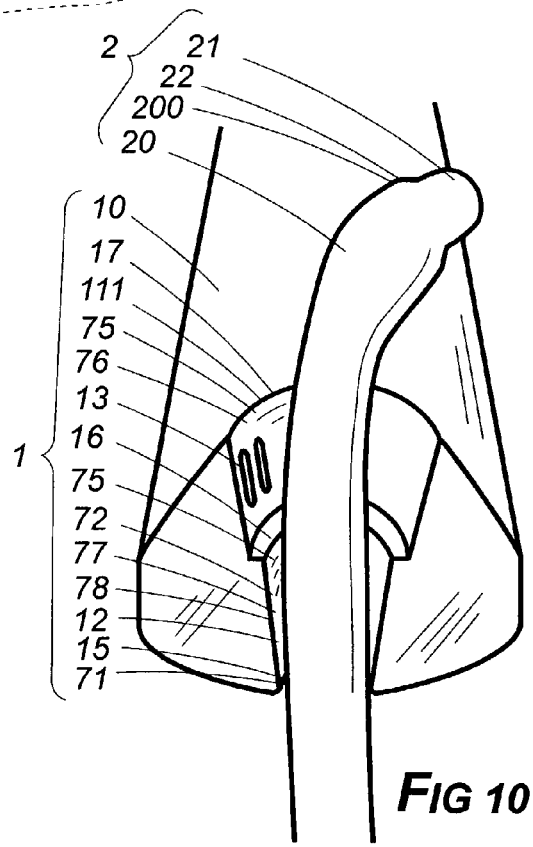

FIGS. 9 and 10 comprise cross-sectional views cut through the tunnel (12) of two distinct embodiments of an assembly in which the shared cavity emplacement wells (75) are concentrically disposed (72). In both drawings, the block emplacement well (76) includes a block retaining ledge (16) to serve as a stop for a handgrip connection block (121, 131). The latter of the drawings includes for block (121, 131) emplacement a conical opening (111) and for impingement means (200) the stoppered end (21, 22) of an exercise cord (20) within the end (21) of which (20) an impingement plug (22) has been inserted. The cord (20) is positioned so that it (20) may be drawn into the cord impingement well (77)—the lower one (75)—for impingement.

Figure 11:
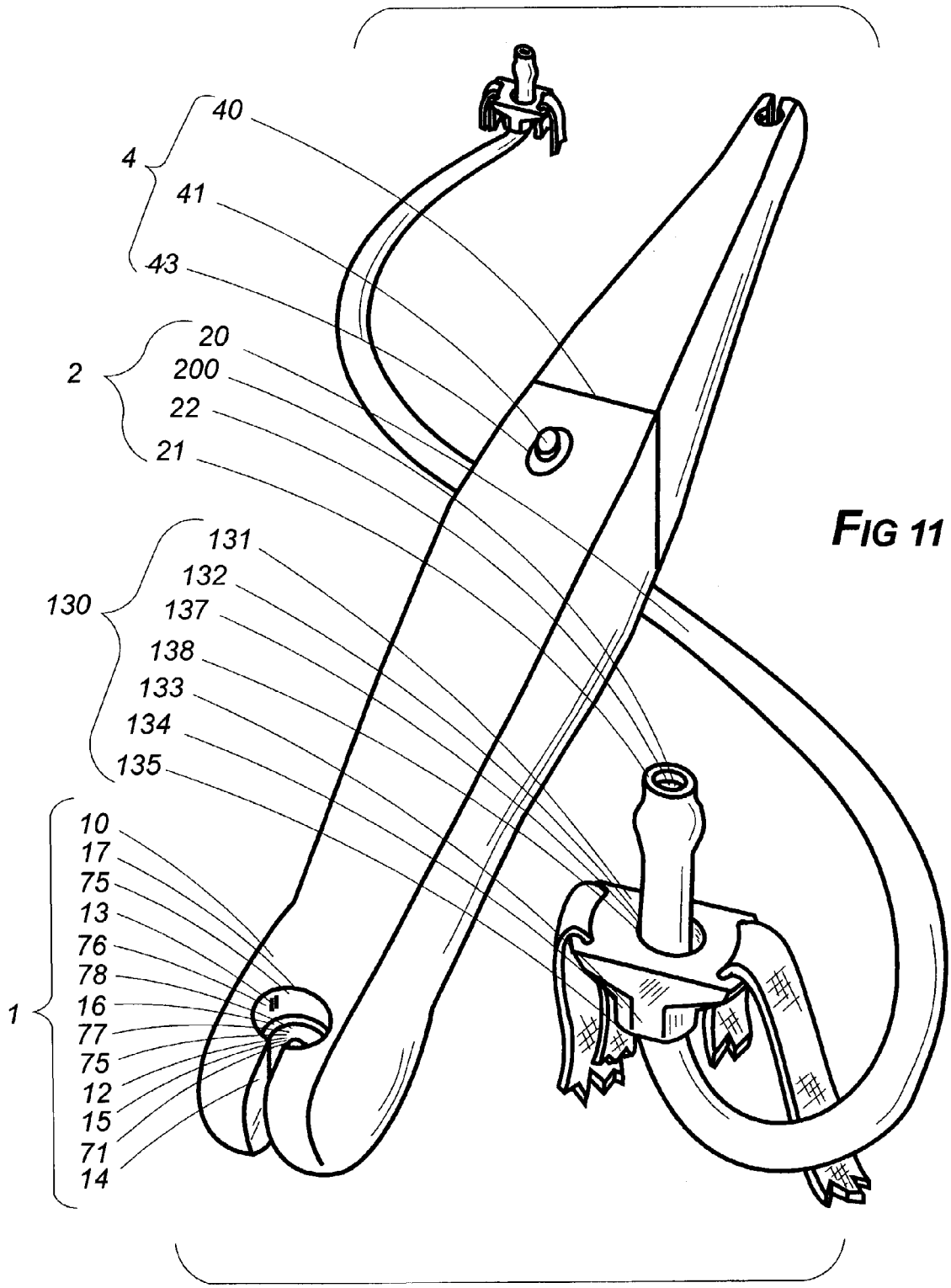

FIG. 11 illustrates an embodiment of the assembly in which strapped handgrips (130) in cut-away portrayal are disposed for emplacement. The connection blocks (131) and shared cavity wells (75) are isolated from one another (131, 75) for viewing purposes. The bar separation assembly (4) is also present. This drawing illustrates the alternative size accommodating configuration character of the block emplacement wells (76) in that here, it is not the stoppered (21, 22) exercise cord (20) which is directly joined to the exercise bar's body (10) as in FIGS. 1, 2, 4–7 and 10 but instead, the strapped handgrip's connection block (131) making that juncture with the cord (20) impinged within it (131).

FIGS. 12 and 13 again include relevant portions (131) of a cut-away strapped handgrip (130) illustrating emplacement of its connection block (131) within the block emplacement well (76). The drawings illustrate the block's (131) position before and after emplacement.

FIG. 14 depicts in perspective an assembly in which the cord connecting blocks (131) of a pair of strapped handgrips (130) are emplaced within the ends of the exercise bar's elongated body (10). In this view, the entire length of the longitudinally extending cord stretching recess (71) is again revealed, illustrating how first mode exercise might be conducted, as mentioned supra. The bar separation assembly (4) is also included. Notice, however, that the connection block (131) parts are not open to view as they were in FIG. 8 because here, the tunnel's cord impingement opening (15) in the bar's body (10), filled with the cord (20) as it (15) is, obscures anything above it (15).

FIG. 15 comprises a cut-away cross-sectional view taken across the cord emplacement slot (14) of an embodiment of the assembly comprising the connection block (131) of a strapped handgrip (130). The block emplacement well (76) is configured within a conical emplacement opening (111) accommodating the strapped handgrip connection block (131) to which it (111) is shown mated in configuration.

FIG. 16 represents a cross-sectional overhead view of one embodiment of the strapped handgrip's connection block (131) in which an axially symmetric neck (133) is disposed within the block emplacement well (76). To enhance the fitting's security, the connection block's cord emplacement slot (136) is shown disposed in deliberate misalignment with the extension's cord emplacement slot (14).

Figure 17:
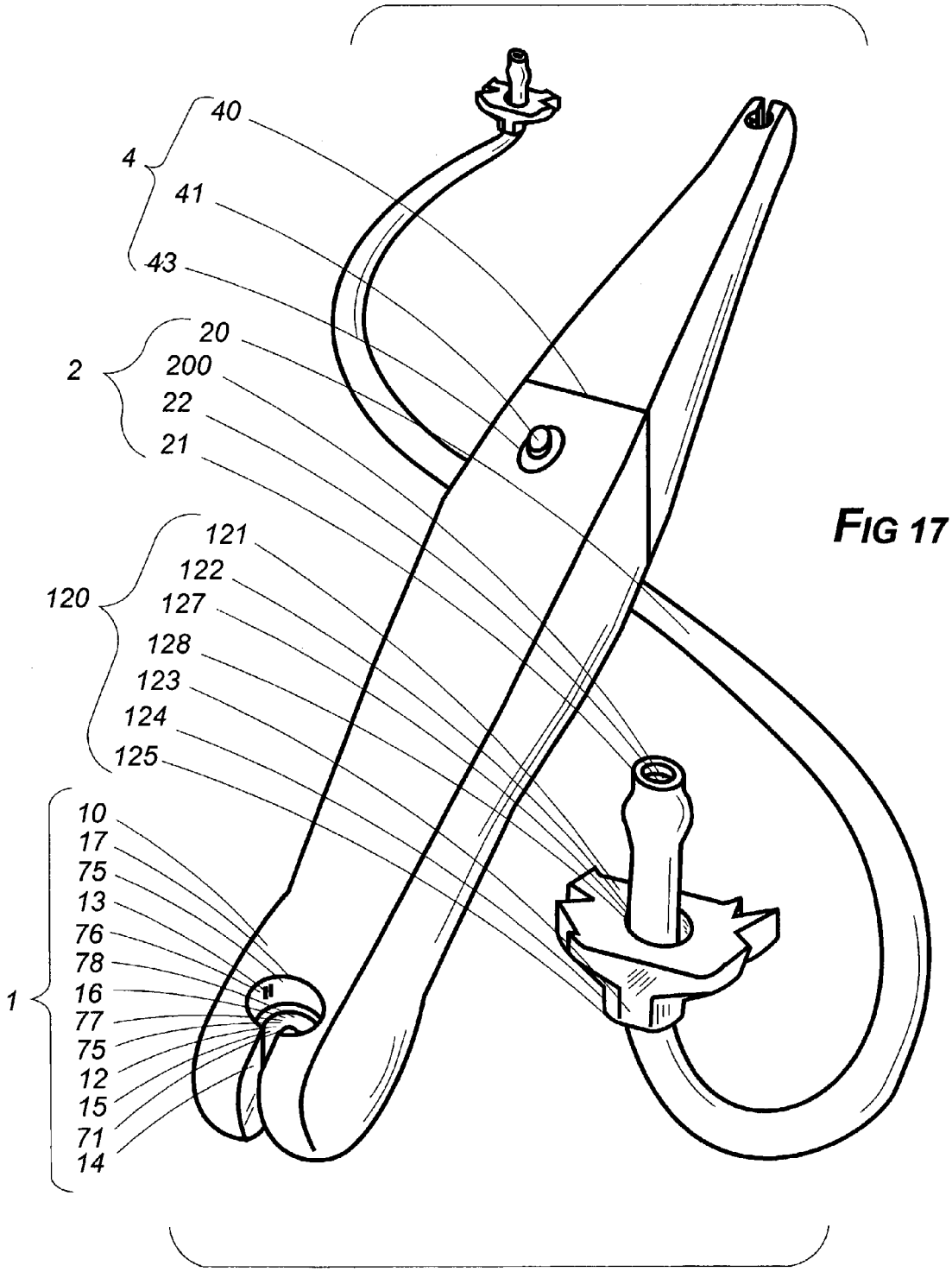

FIG. 17 depicts in perspective features identical to those for the strapped handgrip (130) in FIG. 11, supra, except that here, the handgrip is a solid one (120).

Figure 18:
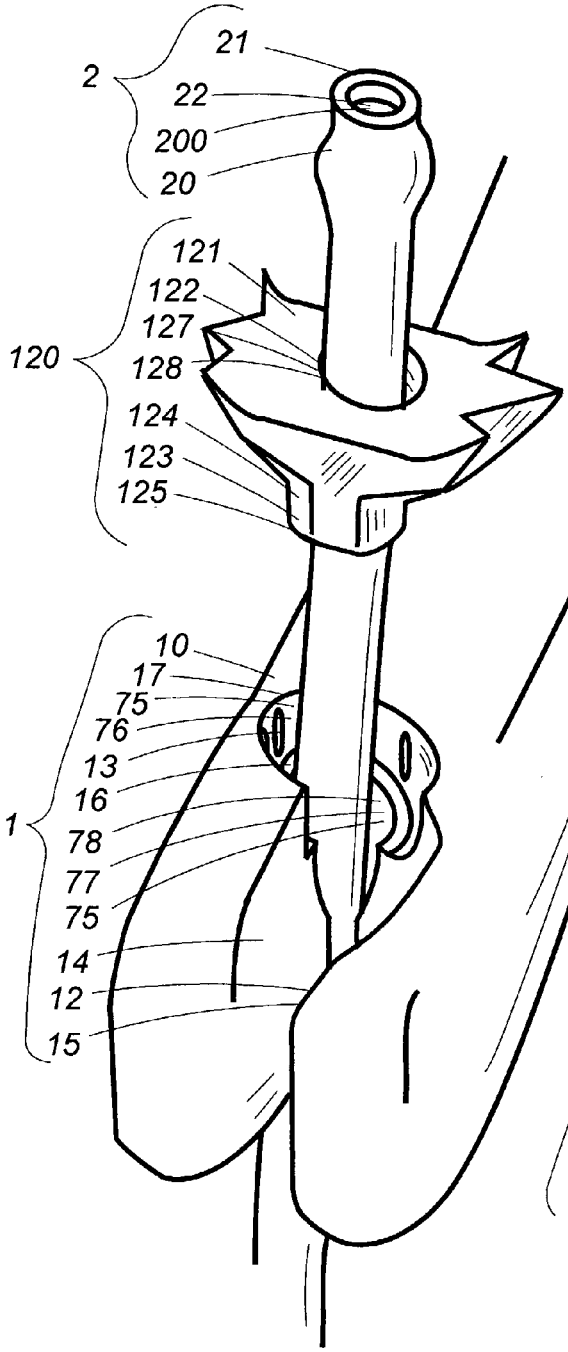
Figure 19:
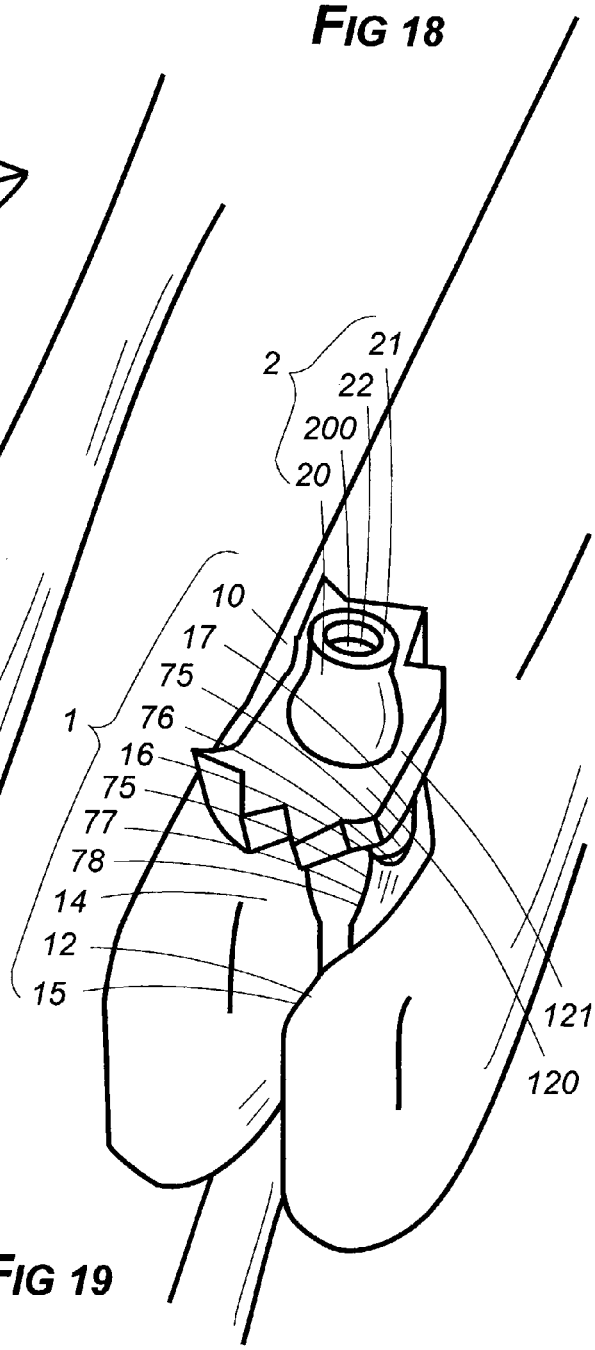

Just as FIGS. 15 and 16, supra, did for the strapped handgrip (130), FIGS. 18 and 19 include in cut-away the relevant portion (121) of a solid handgrip (120) emplaced for use.

The solid handgrip (120) connected assembly of FIG. 20 follows the scheme shown for the strapped handgrip (130) in FIG. 14, supra. Notice the absence of references to connection block (121) parts open to view in otherwise similarly appearing FIG. 8 for the same reasons as in FIG. 14.

Similarly, FIGS. 21 and 22 parallel for the solid grip (120) what FIGS. 15 and 16 do for the strapped one (130), supra.

FIGS. 23–28, cross sections taken proximate the bar's upper surface, illustrate that the emplacement elements of a solid handgrip connection block (121) and strapped handgrip connection block (131) and the block emplacement well (76) comprised by the tunnel (12) may be shaped in numerous ways, so long as the two (121, 76, or alternatively, 131, 76) are mated to one another (76, 121, and 76, 131, respectively). The respective configurations of the first three of the drawings are such that the block (121, 131) and block emplacement well (76) co-engage in only one manner. The symmetry featured in the last three is such that the block (121, 131) may be rotated to fit within its emplacement well (76) in any one of several ways.

Figure 29:
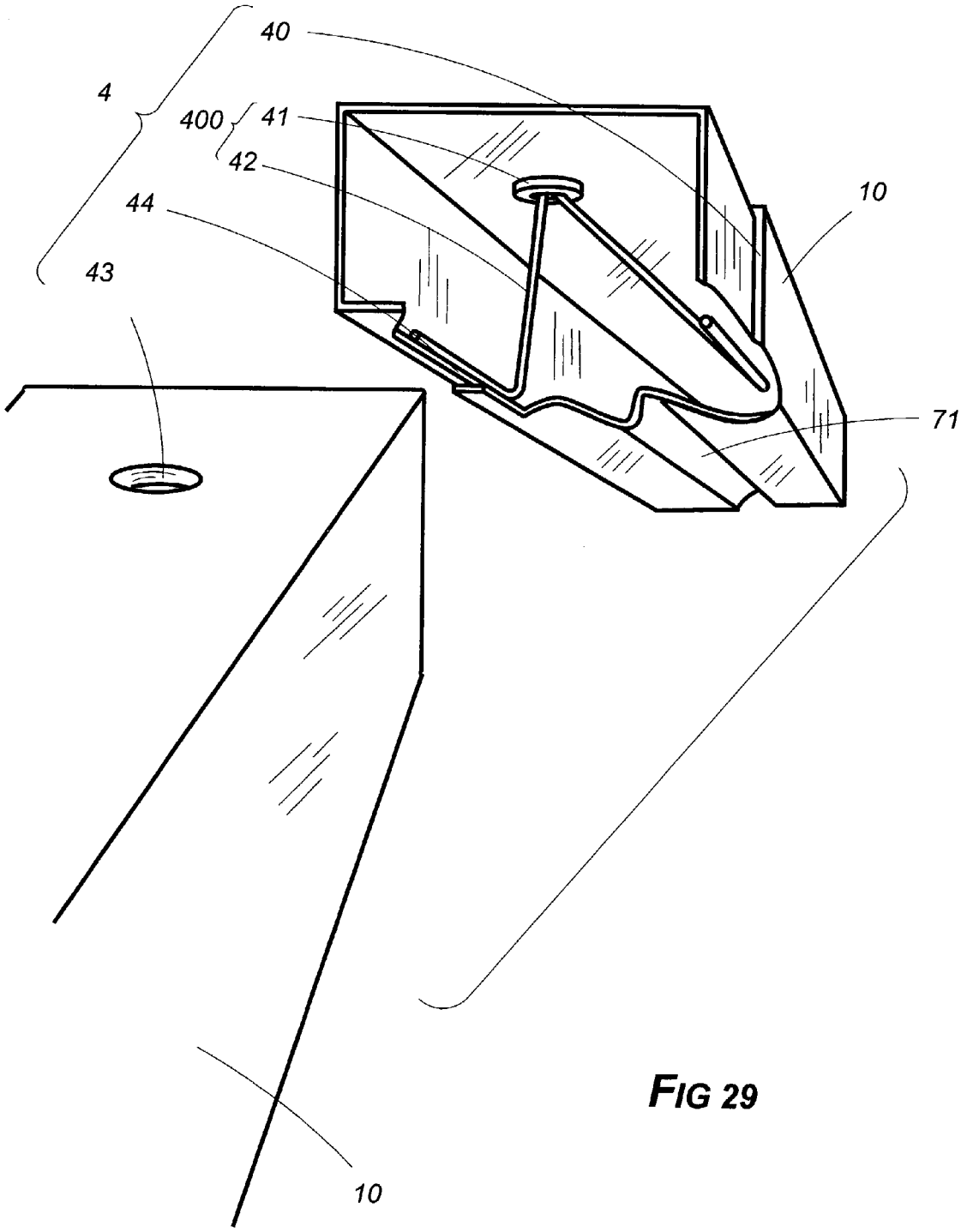

FIG. 29—a perspective view of opposing parts of the exercise bar's elongated body (10)—discloses a bar separation assembly (4) comprising snap-fit means (400) in which a bar separation button (41) is depressed through a button opening (43) and against a grasshopper leg spring (42) seated within to permit the body (10) parts to be slid away from one another.

DESCRIPTION OF THE PREFERRED EMBODIMENT

The subject of this application is a lifting bar and stretchable cord assembly comprised of an exercise bar assembly (1) and an elastic exercise cord assembly (2).

In simplest embodiment, the first of the two general components—the exercise bar assembly (1)—comprises an elongated body (10), an opposing pair of transversely disposed cord tunnels (12) therein (10). An alternative embodiment substituting underlying cord emplacement nests (18) for the tunnels (12) is also provided herein.

By transversely disposed is meant that each tunnel (12) is oriented to cross through the interior of the bar's body (10) from one longitudinal side to an opposing longitudinal side thereof (10)—such as from some point along the length of the top to the bottom of a horizontally disposed body (10). By definition, of course, any tunnel has two oppositely disposed ends or openings and that (12) which comprises part of this embodiment of the subject hereof is no exception. One of the ends of each (12) comprises what is herein designated a first opening (15) which is independently addressed. The other of each tunnel's ends (17) is treated ante. Preferably, the tunnel's (12) passage extends directly across the body's (10) longitudinal axis at a point proximate the ends thereof (10), thereby providing a comfortably held balanced extension.

It is intended that upon assembly, a portion of a stretchable exercise cord's (20) mid-length, addressed ante, repose or lie within the first opening (15) so that it may be retained in place—impinged—at a cord impingement site (78) within the tunnel (12). To that end, the inner diameter of the tunnel's first opening (15) approximates the cord's (20) outer diameter. It is, however, more succinctly stated herein that the first opening (15) comprises size accommodating the disposition of a stretchable exercise cord (20) therethrough. The significance of such expression is that either a non-stoppered cord end (21) may be reeved through the opening (15) or a stoppered (22) one (20) emplaced within it (15) through a body's cord emplacement slot (14) or cord emplacement channel (11) if present, ante. Once the cord (20) is disposed to repose or lie within the tunnel's first opening (15), its end (21) is situated for impingement within the tunnel (12), in which case it is appropriate to insist, as is done herein, that the tunnel (12) comprise size not less than that accommodating the cord's (20) impingement therein.

The second of the major components, the elastic exercise cord assembly (2), comprises a stretchable exercise cord (20) in turn comprising impingement means (200% either the knot or much more preferred embedded impingement plug or stopper (22), supra—to connect it (20) to the exercise cord's body (10) to prevent it (20) from slipping through the tunnel's first opening (15).

Having come thus far, one may now readily conceive of an assembly comprising only a stretchable cord (20) whose ends (21) are connected by means of impingement (200) directly to a bar's elongated body (10). Without more, however, this arrangement does not quite fulfill the needs for true convenience in use, however, because in order to interchange one cord (20) for another (20) of different stretching resistance, one would have to contend with undoing the existing impingement means (200), reeving through the first opening (15) and re-impinging the substituted cord (20).

It is, therefore, highly beneficial for the bar's body (10) to comprise in addition an opposing pair of cord emplacement slots (14) which permit the cord (20) to be brought to its (20) working position. Preferably, the slot (14) is of size requiring the cord (20) to be stretched, thereby thinning a portion of its (20) mid-length, to be slid through it (14). The slots (14) are, accordingly, stated herein to be in communicable access with each tunnel (12). They (14) are not necessarily disposed at the body's (10) ends in orientation parallel the body's (10) longitudinal aspect but may instead have their (14) communicable access from on top, underneath or its (10) sides. The same may be the case for a cord emplacement channel (11) where an underlying cord impingement nest (18) is present, ante. Taking the precaution in manufacture of assuring the presence of the slots (14)—or channels (11) where such is the case-simplifies emplacement of a cord (20) comprising impingement means (200). The addition of this element provides a very respectable assembly.

If the tunnels (12) are properly formed, however, the assembly's functionality can still be considerably enhanced. To this end, the opening in the tunnel (12) opposite the first opening (15) and, therefore designated a second opening (17) herein is made to comprise size accommodating the emplacement of the connection block (121, 131, respectively) of either a solid handgrip (120) or a strapped one (130). Thus, the exercise cord assembly (2) may be either impinged in place within the exercise bar's body (10)—a direct connection—or within a handgrip connection block (121, 131) which is in turn emplaced within the bar's body (10)—an indirect connection. We have, of course, already seen a combination of solid handgrips (120) with a prior art connection bar (100), supra—one having no means of additionally accommodating the impingement of an exercise cord (20) directly. By forming the tunnel's second opening (17) to accommodate these connection blocks (120, 130), the number of interchangeability options is increased with vast sufficiency, fulfilling the objectives outlined supra.

Refinements are suitable even at this level, however. In a preferable version, each cord tunnel (12) comprises a number of what are designated herein as shared cavity emplacement wells (75). By shared cavity is meant that more than one such well (75) is present within the same tunnel (12). Preferably, their (75) disposition is concentric (72) and the number thereof (75) is two, one of them characterized as a handgrip block emplacement well (76%—its size permitting the emplacement of a handgrip connection block (121, 131), the other, as a cord impingement well (77)—its size permitting impingement of a stoppered (22) cord end (21). Accordingly, the block emplacement well (76) is said herein to accommodate emplacement of the connection block (121, 131) and, consistently, the cord impingement one (77) is said to accommodate impingement of the stretchable exercise cord (20). While the two (77, 76) may be of equal size, it is preferable the latter (77) comprise size smaller than the former (76). The uppermost edge of each well (75), forms a step-like discontinuity—however slight—between them (75). Such distinct compartmentalization for each coupling mechanism—the stoppered (22) cord end (21) and the handgrip connection block (121, 131)—makes each of the two wells (76, 77) more functional, enabling them (76, 77) to retain their (76, 77) respective contents (21 and 121, 131) more securely.

It is preferred that the cord impingement well (77) comprise configuration mated to the exterior of the stoppered (22) cord end (21), thereby providing a snug fit. In view of what has been said, it is appropriate, to speak of the shared cavity emplacement wells (75) as comprising alternative size accommodating configuration—that is, to express that they (75) accommodate within them (75) connectors of different size.

In the preferred model, a step-like configuration shown in FIGS. 1, 3, 6, 7, 9–13, and 17–19 is disposed at the lower portion of the block emplacement well (76)—that is, the larger shared cavity well (75)—providing a stop for the connection blocks (121, 131) of a solid or strapped handgrip (120, 130, respectively). This step-like structure is herein designated a block retaining ledge (16). It is not a matter of great importance which portion of the block (121, 131) becomes retained by the ledge (16)—that is, whether it is the portion thereof (121, 131) inserted farthest into the opening (17) or some intermediate point along its neck (123, 133). So far as a similarly functioning stop for the impinged cord end (21) is concerned, that may be considered to have been inherently provided by the configuration of the first opening itself (15), which may be somewhat rounded along the contacting edge to prevent abrasion.

It becomes apparent that the impingement concepts attributable to cord (20)-to-handgrip connection block (121, 131) may be properly carried over to those concerning cord (20)-to-exercise bar body (10) as they have been herein. The nomenclature is parallel in that we again have an impingement site (78) disposed within a tunnel (12) comprising a first opening (15) of size accommodating the disposition of a stretchable exercise cord (20) therethrough (15), the site itself (78) comprising size accommodating the cord's (20) impingement therein (12). Consistently there is also a cord emplacement slot (14) through which (14) the stretchable cord (20) can be brought into place. A difference in the exercise bar's body (10), however, is that we additionally have a second tunnel opening (17) comprising size accommodating the emplacement of a handgrip's connection block (121, 131). The second opening (127, 137) in a handgrip's connection block (121, 131) is not relevant to this function and cannot, therefore, be addressed in any parallel sense.

Eschewing protrusions for cord (20) wrapping convenience, supra, confers upon the body (10) what is designated herein as continuously contoured projection. The word continuously infers the absence of the familiar structural discontinuities known in the art and instead provides either a straightly formed body in which the perimeter along any longitudinal cross section extends in a generally straight line, or a smoothly formed or streamlined one comprising slightly arcuate configuration. Changes in curvature along the way are also permitted within the scope of the definition. Bodies (10) comprising continuously contoured projection configuration are illustrated in FIGS. 1, 3–8, 11–14, 17–20 and 29.

Preferably present is also a cord stretching recess (71) disposed longitudinally along the body's (10) underside for optional traditional first mode exercise, supra. In use, the cord (20) seats within the length of the recess (71) with its ends (21) distally anchored as discussed supra.

As FIGS. 11, 12, 15–17, 21, 22 and most clearly 23–2, demonstrate, a block's neck (123, 133) may comprise any one of a number of shapes along its (123, 133) axial cross-section. It is merely necessary that the tunnel's second opening (17) be mated to it (123, 133) in configuration. If the shape is non-symmetrical, as in FIGS. 23–25, the number of ways the block (123, 133) will fit within the opening (17) is very limited, amounting to no more than one in many cases. If the shape is symmetrical, however, the block (123, 133) may conveniently be axially rotated to fit in any one of a number of ways.

It is not essential upon assembly that the bar's cord emplacement slot (14) and the handgrip block's cord emplacement slot (126, 136), if both (14 and 126, 136) are included in structure, be disposed in alignment with one another (14 and 126, 136). It should be apparent that deliberately setting them (14 and 126, 136) in misalignment would enhance the assembly's cord (20) connecting security. Axial symmetry of the connection block's neck (123, 133) then provides a convenience in which the cord (20) is brought into place more or less simultaneously and the connection block (121, 131) then axially rotated within the opening (17) to a non-aligned position.

Figure 23:
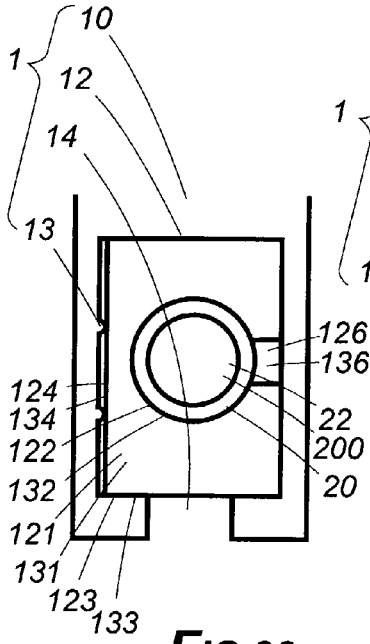
Figure 24:
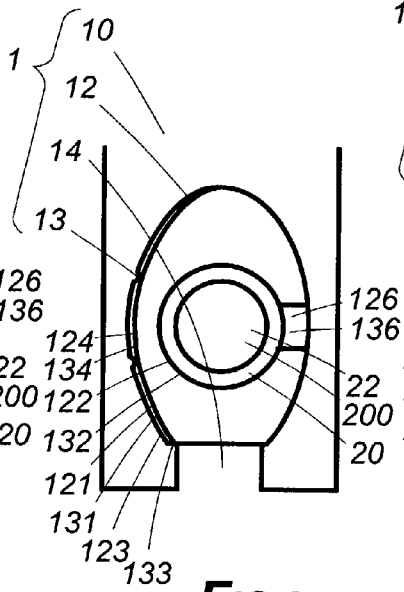
Figure 25:
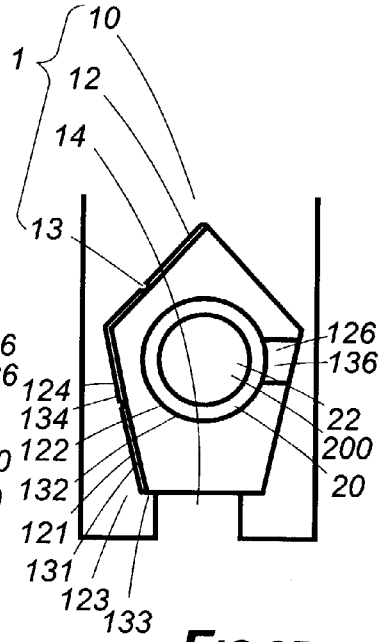

While axial symmetry of the handgrip connection block's neck (123, 133), as shown in FIGS. 23–25, is a considerably preferred configuration, the tunnel's second opening (17) may be manufactured to mate to particular shapes. It (17) may, for example, be shaped to accommodate the connection block (131) of an already available popular strapped handgrip assembly [(130)—(130)—such as in the case in FIG. 17 or, perhaps, as also already extant in prior art, FIG. 5, the cord connecting end (121) of a solid handgrip assembly (120)—comprising the same non-symmetry in shape. This might well suggest a reason to manufacture a more or less universal cross-sectional shape for handgrip connection block necks (123, 133).

The connecting block (121, 131) need not be strictly cylindrical but may comprise conical or truncated conical configuration—that sometimes referred to as frusto-conical—with the tunnel's second opening (17) mated to it (121, 131) in shape. Even though the inconvenience of dislodgement would probably occur if the assembly were momentarily inverted, emplacement may, nevertheless, be considered sufficiently secure for exercise. After all, the tugging of the cord (20) during exercise forces the block (121, 131) more tightly against its (121, 131) lodgement site.

As a matter of convenience, however, it is preferable that the handgrip block (121, 131) be firmly retained in place when preparing for exercise or even during intermediate intervals of non-exercise. Within each tunnel's second opening (17), therefore, one or more impingement nodes (13) are preferably present. The node (13) is merely a small protrusion along the lateral periphery or wall of the opening (17) against which the emplaced connection block's neck (123, 133) becomes impinged when pressed into place.

Figure 12:
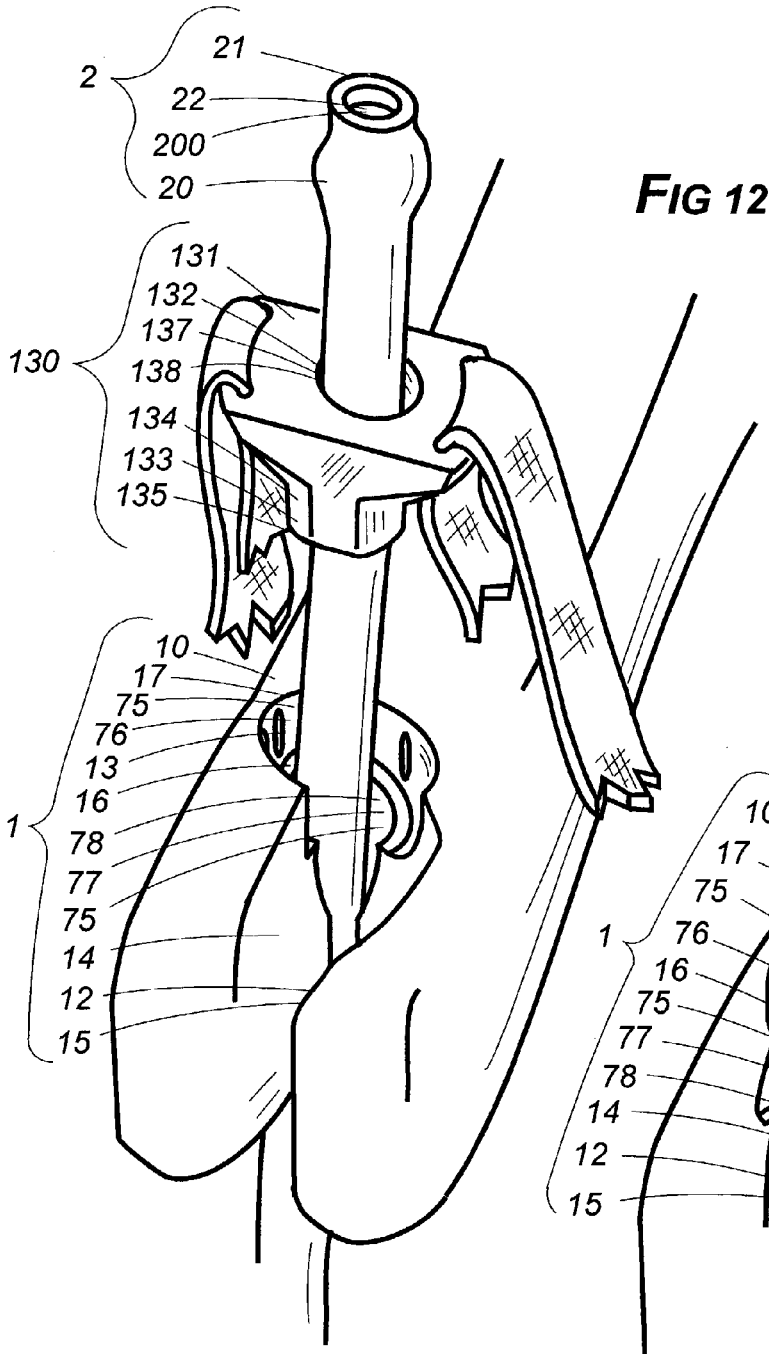
Figure 13:
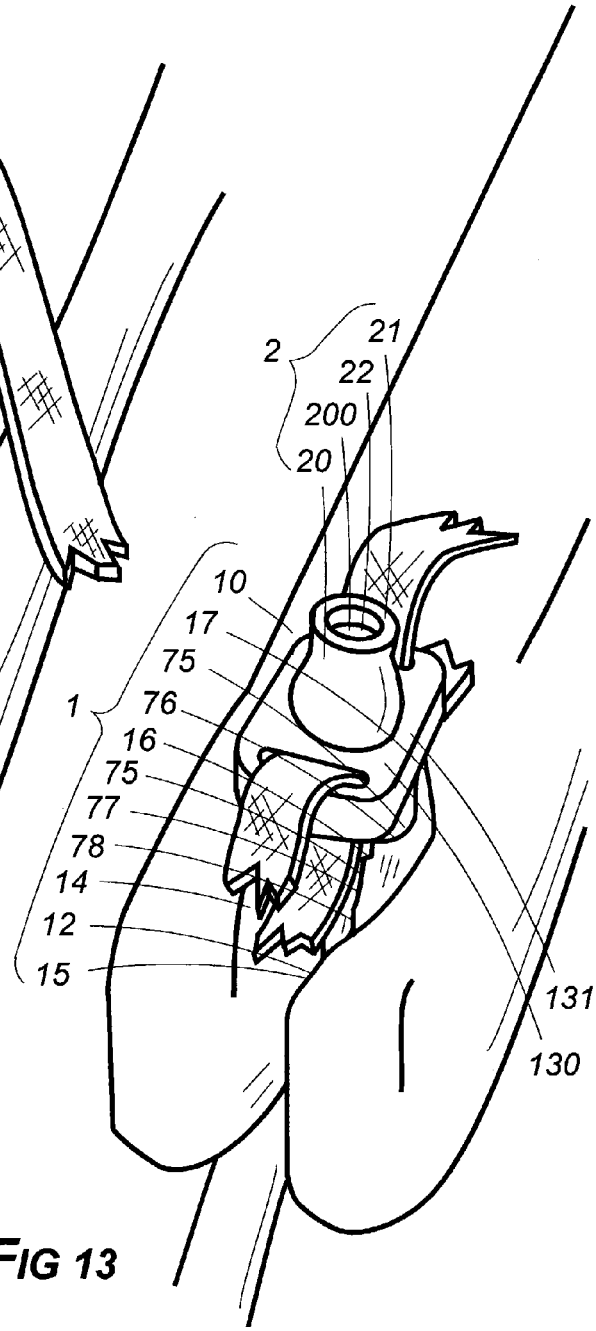

The portion of the neck (123, 133) which contacts the node (13) is herein designated the block's impingement sector (124, 134). A number of them (124, 134) may be disposed around the block's neck (123, 133), consistent with the number of ways block (121, 131) emplacement is possible. When manufacture is by molding, the incorporation of nodes (13) and handgrip connection block impingement sectors (124, 134) is a simple matter. It is merely necessary that the two (13 and 124, 134) contact one another (124, 134 and 13) tightly. Although nodes (13) are shown in FIGS. 12 and 18, together with conical connection block (131, 121, respectively) and second opening (17) configuration, straight vertical walls are preferred.

Impingement nodes (13) are visible in FIGS. 1, 3–10, 12–15, 29 and 18–25. As those illustrations show, a small clearance is necessarily formed proximate the nodes (13) at that portion of the wall of the second opening (17) upon which they (13) are situated. The reference to the "mating" of shapes as used herein, therefore, takes that small separation difference into account. Although the tolerances of these impingement features do not appear to rise to the definition herein of rigid emplacement, supra, they must be such as to provide a suitably secure fit for exercise purposes.

Figure 26:
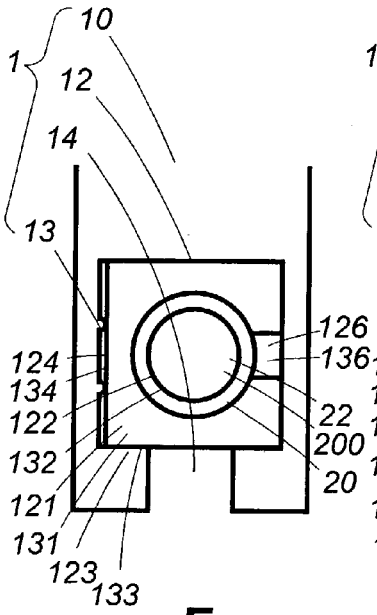
Figure 27:
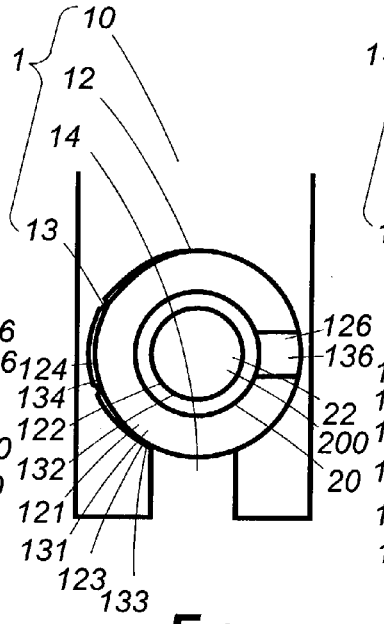
Figure 28:
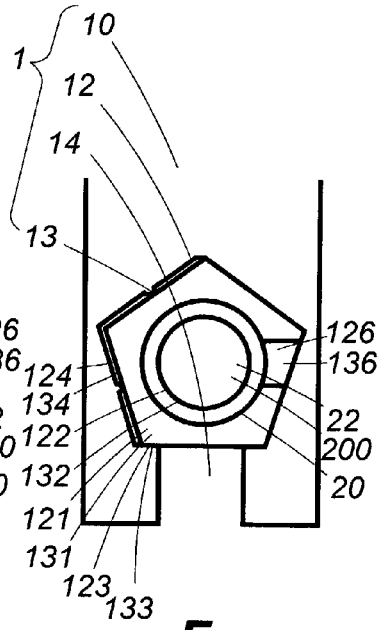

The bar separation assembly (4) disclosed in FIG. 26 represents a preferred feature also indicated in FIGS. 1, 11, 17 and 29 and with lesser sophistication in FIGS. 8, 14 and 20. This assembly (4) comprises a bar separation seam (40), a button opening (43) and what is widely recognized in prior art as snap-fit means of connection (400). Herein, such means (400) preferably comprises a release button (41) and an exercise bar grasshopper separation spring (42) connected both to it (41) and a separation spring seat (44).

The bar separation seam (40) comprises merely the dividing place between the two parts of the bar's elongated body (10). When the two pieces are interconnected, the release button (41) is disposed to emerge through the button opening (43)—merely an orifice in the body's extension (10). The two pieces are preferably shaped to slide together in telescope-like fashion as FIG. 26 indicates they would. The grasshopper leg spring (42)—so named because of its strength and resilience when bent and seated as shown there—is connected to the release button (41) in any known manner; preferably by impingement within a hollow disposed within the button (41). The mid-portion of the spring (42) may be bent to accomplish this fitted connection. The ends of the spring (42) are then preferably bent as shown and fitted along portions within the body (10) to provide a firm tensioning seat. When the button (41) is depressed, it (41) clears the opening (43) and the two body (10) pieces may be pulled apart at the separation seam (40). When the pieces are slid back together, by reason of the tension provided by the grasshopper leg spring (42), the button (41) pops through the opening (43) the instant the two (41, 43) become aligned. One may conceive of various other snap-fit means (400), of course. While many (400) are, in fact, readily available on the market, for various contraptions and at least one incorporated within one of the more recent prior art models, the one presented herein is simple to manufacture and particularly suited to the assembly. Although great effort is not required to snap-fit the body's (10) pieces together or pull them apart once the release button (41) is depressed, because of the body's (10) structural integrity, the connection is properly considered one of rigid emplacement.

In a different embodiment of the assembly, the tunnels (12) are absent, underlying cord impingement nests (18) being provided to take their (12) place. The impingement nest (18) resembles in certain respects the tunnels (12) they (18) replace but, unlike the two-ended tunnel (12), comprises but a single opening (19). Thus, the nest (18) may be envisioned by removing the upper portion of the tunnel (12), sealing it (12) off, as it were. The nest's opening (19) may be considered in the same light as the tunnel's first opening (15). The nests (18) must be of size permitting the impingement of the cord end (21) therein (18) and their openings (19) must be of size to keep the impinged end (21, 22) from being pulled through. Like the tunnels (12), they (18) are transversely disposed within the bar's body (10).

Given nothing more, of course, there would be no feasible way of installing the impinged cord end (21, 22) into the socket-like nest (18). A cord emplacement channel (11) is, therefore, provided through which the impinged cord (22) may be slid to bring it (22) into the nest's (18) interior. To accomplish this, the channel (11) is preferably more or less concave in cross-section. As in the case of the tunnel (12), it is preferable to configure the channel with diameter narrower than that of the cord (20), which may be stretched or squeezed to force it (20) into place. In instances in which it is not desired that handgrips (120, 130) be employed with the assembly, the underlying cord impingement nest (18) provides a plausible structural alternative conferring an attractive streamlined look upon it.

What is claimed is:

1. A lifting bar and stretchable cord assembly comprising an exercise bar assembly; and an elastic exercise cord assembly;

the exercise bar assembly comprising an elongated body;

an opposing pair of transversely disposed cord tunnels, one end of each thereof comprising a first opening of size accommodating the disposition of a stretchable exercise cord therethrough, the tunnel comprising size accommodating the cord's impingement therein; the elastic exercise cord assembly comprising a stretchable exercise cord disposed for impingement within a respective cord tunnel and comprising means of impingement for connection to the exercise bar's body; the exercise bar's body comprising a pair of cord emplacement slots disposed, respectively, for communicable access with each tunnel;

the tunnel end disposed opposite that comprising the first tunnel opening comprising a second tunnel opening comprising size accommodating the emplacement of a handgrip's connection block;

each cord tunnel further comprising two or more shared cavity emplacement wells one of them a handgrip emplacement well comprising size permitting the emplacement of a handgrip connection block, another of them a cord impingement well comprising size permitting impingement of the cord disposed therein;

whereby by reason of the tunnels' configuration and the cord's impingement means, to benefit certain muscles, an operator may undertake any one of a number of second mode exercises against the cord's elastic resistance; by reason of the cord emplacement slots, the cord's emplacement witin the bar for impingement in preparation for use in either first or second mode is facilitated;

and by reason of the sizes of the second tunnel openings for handgrip connection block emplacement, an operator may immediately shift from independent handgrip assembly exercises to second mode exercise bar use against the same elastic resistance without disconnecting the exercise cord from the handgrips.

2. The lifting bar and stretchable cord assembly according to claim 1 comprising a bar separation assembly comprising snap-fit means of connection comprising in turn a release a button and an exercise bar grasshopper separation spring connection to it and a separation spring seat;

whereby upon depressing the button, it is cleared from an otherwise obstructing site, permitting opposing portions of the exercise bar's elongated extension to separate from one another; and, upon rejoining the portions and releasing the button and causing it to co-engage a button opening, the grasshopper spring returns the button to its obstructing disposition wherein separation of the portions is prevented.

3. The lifting bar and stretchable cord assembly according to claim 1 wherein the stretchable exercise cord comprises hollow configuration and its means of impingement for connection to the exercise bar's body comprises a cord impingement plug disposed by rigid emplacement within it.

4. The lifting bar and stretchable cord assembly according to claim 1 wherein the exercise bar's body further comprises a cord stretching recess;

wherein the mid-portion of the stretchable cord may be emplaced along the recess and the cord ends anchored in any manner;

whereby first mode exercise is facilitated.

5. The lifting bar and stretchable cord assembly according to claim 1 wherein the exercise bar's elongated extension comprises continuously contoured projection;

whereby rotational positioning of a handgrip's connection block upon emplacement for second mode exercise is unimpeded.

6. The lifting bar and stretchable cord assembly according to claim 1 wherein the handgrip's connection block is configured from top to bottom with axial symmetry;

whereby unobstructed rotational positioning of a handgrip's connection block upon emplacement for second mode exercise is further assured.

7. The lifting bar and stretchable cord assembly according to claim 1 wherein the handgrip connection block within which the stretchable cord is impinged comprises that of a strapped handgrip.

8. The lifting bar and stretchable cord assembly according to claim 1 wherein the handgrip's connection block comprises a cord emplacement slot;

whereby emplacement of the cord im preparation for use in either first or second mode exercise is further facilitated.

9. The lifting bar and stretchable cord assembly according to claim 1 wherein the cord impingement well comprises size smaller than that of the handgrip emplacement well.

10. The lifting bar and stretchable cord assembly according to claim 1 wherein the shared cavity emplacement wells comprised by each cord tunnel's second opening are but two thereof in number which are concentrically disposed.

11. The lifting bar and stretchable cord assembly according to claim 1 wherein the configuration of each handgrip emplacement well is conical and a handgrip's connection block comprises a neck mated to it in configuration for use in second mode exercise.

12. The lifting bar and stretchable cord assembly according to claim 1 wherein both the accommodation of a connection block by one shared cavity emplacement well and the accommodation of the stretchable cord end by another shared cavity emplacement well is snug.

13. The lifting bar and stretchable cord assembly according to claim 1 wherein each larger shared cavity emplacement well comprises a block retaining ledge and one or more block impingement nodes; and a handgrip's connection block, one or more impingement sectors; whereby the security of the connection block within the larger well is enhanced for second mode exercise.

* * * * *